US009387353B2

(12) United States Patent
Lloyd

(10) Patent No.: US 9,387,353 B2
(45) Date of Patent: Jul. 12, 2016

(54) FITNESS AND EXERCISE DEVICE

(76) Inventor: Gilbert Lloyd, Harvey, IL (US)

( * ) Notice: Subject to any disclaimer, the term of this patent is extended or adjusted under 35 U.S.C. 154(b) by 797 days.

(21) Appl. No.: 12/932,697

(22) Filed: Mar. 3, 2011

(65) Prior Publication Data

US 2012/0225755 A1 Sep. 6, 2012

(51) Int. Cl.
*A63B 15/02* (2006.01)
*A63B 21/00* (2006.01)

(52) U.S. Cl.
CPC ..... *A63B 21/0004* (2013.01); *A63B 21/00192* (2013.01); *A63B 21/4017* (2015.10); *A63B 21/4025* (2015.10); *A63B 21/4047* (2015.10)

(58) Field of Classification Search
CPC ..... A63B 21/00192; A63B 2209/08; A63B 21/0004; A63B 21/00; A63B 21/005–21/0059; A63B 21/02–21/028; A63B 21/04–21/0455; A63B 21/05–21/0557; A63B 21/4011; A63B 21/4017; A63B 21/4047; A63B 23/0494; A63B 71/12; A63B 71/1225; A63B 71/1281; A63B 71/14; A63B 2071/125
USPC ..... 482/1, 92, 148; 473/205, 207, 212–217, 473/266, 274–277; 602/5, 41, 60–73, 1, 22, 602/262
See application file for complete search history.

(56) References Cited

U.S. PATENT DOCUMENTS 3,421,500 A * 1/1969 Jacobson ..... A61F 5/013 482/148
3,659,846 A * 5/1972 Kanicki ..... A63B 21/023 2/24
3,976,057 A 8/1976 Barclay
4,065,814 A 1/1978 Fox
4,273,328 A * 6/1981 Ozbey ..... A63B 21/00185 2/115
4,606,542 A * 8/1986 Segal ..... A61F 5/0125 482/105
4,815,731 A * 3/1989 Suarez ..... A63B 21/055 482/124
5,005,827 A * 4/1991 Steinbrecher ..... A63B 5/04 24/303
5,014,981 A * 5/1991 Prelich ..... A63B 21/00192 482/106
5,167,601 A * 12/1992 Frappier ..... A63B 21/0004 482/121
5,306,222 A 4/1994 Wilkinson
5,308,305 A 5/1994 Romney
5,518,480 A * 5/1996 Frappier ..... A63B 21/0004 482/124
5,683,336 A 11/1997 Pape
5,778,452 A 7/1998 Dicker
5,788,618 A * 8/1998 Joutras ..... A43B 1/0054 482/114
5,974,588 A * 11/1999 Furman ..... A41D 19/01517 2/159
5,978,966 A 11/1999 Dicker
5,980,435 A * 11/1999 Joutras ..... A43B 1/0054 482/114

(Continued)

*Primary Examiner* — Oren Ginsberg
*Assistant Examiner* — Garrett Atkinson
(74) *Attorney, Agent, or Firm* — Paul E. Schaafsma; David H. Dzlura

(57) ABSTRACT

A fitness and exercise device utilizes magnetic force to facilitate energy expenditure, muscle build up and weight loss upon the swinging of bending of the arms and/or legs and/or body. The device comprises an upper and a lower pad, sized to be disposed over the front side of the joint, with the upper pad overlying an upper part of the limb and with the lower pad overlying a lower part of the limb. Magnetic force is generated by magnetic energy sources of opposite polar orientation incorporated into an upper pad and a lower pad disposed above and below over the front side of a joint, with an upper pad overlying an upper part of the limb and with a lower pad overlying a lower part of the limb. When the joint is straight the magnetic energy sources are positioned sufficiently close so that they attract. When the arm is being bent the magnetic energy sources exert resistance due to their opposite polar orientation. The wearer must thus exercise additional force to overcome the resistance exerted by the magnetic energy sources.

8 Claims, 10 Drawing Sheets

(56) References Cited

U.S. PATENT DOCUMENTS 6,053,852 A 4/2000 Wilkinson
6,099,446 A 8/2000 Johnson
6,119,271 A * 9/2000 Byon ..... A63B 21/065 2/161.2
6,245,002 B1 * 6/2001 Beliakov ..... A63B 21/00192 482/148
6,368,296 B1 * 4/2002 Eiter ..... A63B 21/4009 482/146
6,585,611 B2 7/2003 Vogel
6,892,396 B2 5/2005 Uno et al.
6,962,555 B2 11/2005 Behman
7,354,385 B2 4/2008 Virji
7,516,498 B2 4/2009 Torry
7,631,367 B2 12/2009 Caillibotte
7,821,367 B2 * 10/2010 Fullerton ..... H01F 7/0215 2/102
7,867,145 B2 * 1/2011 Bearden ..... A63B 21/00192 2/160
8,052,546 B1 * 11/2011 Nagel ..... A63B 21/4019 473/422
8,820,808 B1 * 9/2014 Chud ..... A45F 5/10 294/141
9,033,855 B2 * 5/2015 Opfer ..... A63B 21/028 482/121
2002/0022550 A1 * 2/2002 Pham ..... A63B 21/00192 482/1
2005/0071906 A1 * 4/2005 Infante ..... A63B 71/1225 2/22
2006/0185057 A1 * 8/2006 Terpinski ..... A41D 13/087 2/160
2006/0229160 A1 * 10/2006 Talluri ..... A63B 21/00192 482/1
2007/0006367 A1 * 1/2007 Newman ..... A45F 3/12 2/338
2007/0135279 A1 6/2007 Purdy
2007/0266476 A1 * 11/2007 Ulrich ..... A42B 1/045 2/202
2008/0313791 A1 * 12/2008 Nagely ..... A42B 3/0473 2/425
2009/0082182 A1 3/2009 Lloyd
2009/0083901 A1 * 4/2009 Pardillo ..... A41D 13/065 2/455
2010/0024175 A1 * 2/2010 Cserpes ..... A45F 5/04 24/303
2010/0261581 A1 * 10/2010 Bearden ..... A63B 21/00192 482/47
2010/0263110 A1 * 10/2010 Berry ..... A42B 3/0473 2/459
2011/0053736 A1 * 3/2011 Bearden ..... A63B 21/00192 482/47
2015/0011338 A1 * 1/2015 Russotti ..... A63B 69/00 473/422

* cited by examiner

FITNESS AND EXERCISE DEVICE

FIELD OF THE INVENTION

The present invention relates to fitness and exercise devices.

BACKGROUND OF THE INVENTION

Various devices have been suggested to provide resistance to activities, which include swinging or bending of the arms and/or legs and/or body. For example, in the use of one type of such devices, a garment that includes a resistance material is provided such that when the user performs certain activities, such as bending motions of the hands, legs or body, energy is expended in stretching the resistance material. Thus, when worn over prolonged periods of time, these devices are thought of as a means of aiding in fitness and exercise in the sense that the energy expended during an activity by someone wearing the garment would be more than if the same person were involved in the same activity without wearing the garment.

Another type of such device involves the use of garments where elastic elements such as elastic cords or bands which are attached to the garment are used to provide resistance. For example, one such garment includes an outer and an inner layer joined together, wherein each layer has a shirt and trouser section. Elastic band members are disposed between the inner and outer layers of the suit. Another such garment includes an article of clothing including gloves and socks worn on the body with anchor members worn at the gloves and socks. A connecting element is connected to the article of clothing and the anchor members by interconnecting the gloves. A second set of connecting members connect the socks to the garment. Each connecting element is made of an elastic material so as to offer resistance during the movement of the arm or leg in motion. Finally, another such garment includes an elastic ring section secured to the base fabric of the garment. The elastic ring section is made of a material which applies a greater longitudinal resistance force to the body of the wearer than the material of the base fabric. The base fabric is located longitudinally outwardly of the ring section so that there are alternating regions of differing longitudinal resistive characteristics.

Nevertheless, such devices experience a number of drawbacks. One of the drawbacks is the inability of such devices to provide high levels of resistance necessary for building strength of muscle. Thus, if used as a sole source of resistance, such devices typically can be utilized only as a supplement to an already existing resistance producing activity. Users engaged in strength training or muscle building must use such devices in conjunction with other resistance producing devices in order to achieve the desired level of resistance.

Another drawback of such devices is that the desired level of resistance provided by such devices cannot be readily varied by the user. Thus, users of such devices cannot engage in a typical strength or muscle building activity whereby resistance is increased in subsequent sets of a routine while the number of repetitions is decreased, or in other types of routines which require varying levels of resistance.

Moreover, such devices typically are not compact in size. Even if such devices were sufficiently compact, their inability to produce high and varying levels of resistance would require users of such devices to use additional resistance producing devices, in order to incorporate more than one resistance setting.

Finally, the devices which are incorporated into garments typically cannot be used without the garments. Similarly, other devices, which are used without being incorporated into garments, typically cannot be incorporated into garments.

Thus, what would be desirable would be a device that would be capable of producing high levels of resistance. What would also be desirable would be a device capable of producing resistance of varying levels, whereby the level of resistance could readily be adjusted by users. What would also be desirable would be a device which would also be sufficiently compact in size to allow users to transport such device easily to any desired setting. Finally, what would be desirable would be a device that could be utilized on its own or which could be incorporated into a garment.

SUMMARY OF TILE INVENTION

A fitness and exercise device in accordance with the principles of the present invention is capable of producing high levels of resistance. A fitness and exercise device in accordance with the principles of the present invention is capable of producing varying levels of resistance. A fitness and exercise device in accordance with the principles of the present invention is sufficiently compact such that it can be comfortably worn by the user, even in an embodiment that provides the highest resistance. Finally, a fitness and exercise device in accordance with the principles of the present invention can be used with being or without being incorporated into garments.

In accordance with the principles of the present invention, a fitness and exercise device is provided which incorporates magnetic force to provide resistance in the arms and/or legs and/or body. A fitness and exercise device of the present invention can be worn by the user by itself or it can be incorporated into a garment so as to generally conceal the device. A fitness and exercise device of the present invention provides resistance to the wearer of the device thereby facilitating additional energy expenditure, muscle build up and weight loss upon the swinging or bending of the arms and/or legs and/or body.

In one embodiment, a fitness and exercise device of the present invention includes an upper pad and a lower pad worn over a limb. Magnetic energy sources of opposite polar orientation are incorporated into the pads, with at least one magnetic energy source of a first polar orientation being incorporated into an upper end of the lower pad and at least one magnetic energy source of an opposite polar orientation being incorporated into a lower end of the upper pad. When the limb is straight the magnetic energy sources are positioned sufficiently close so that they attract. When the arm is being bent the magnetic energy sources exert resistance due to their opposite polar orientation. The wearer must thus exercise additional force to overcome the resistance exerted by the magnetic energy sources. In an additional embodiment, at least one elastic element can be secured between the upper pad and the lower pad to exert additional resistance upon the bending of the limb.

DETAILED DESCRIPTION OF THE PREFERRED EMBODIMENTS

Figure 1:
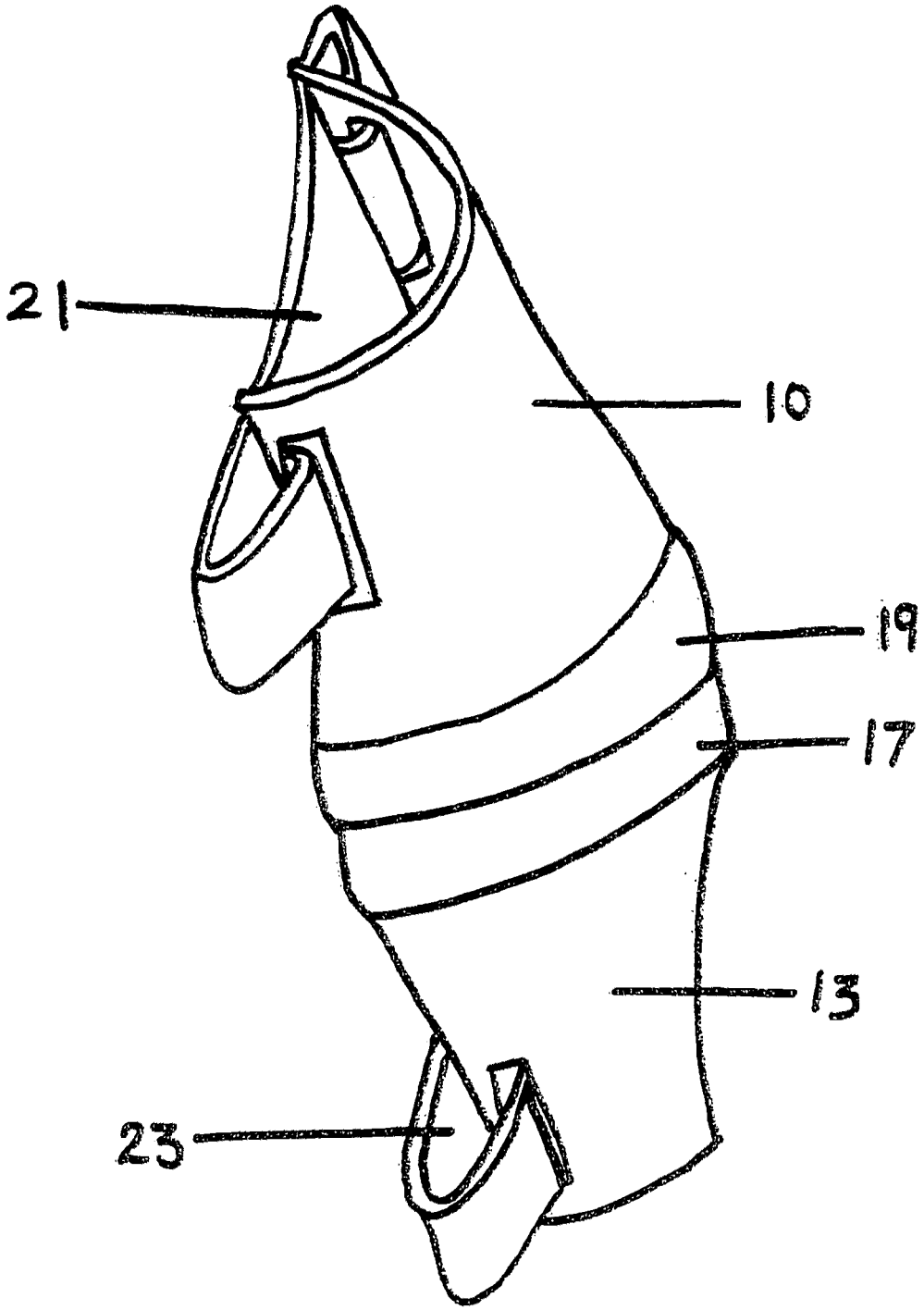
FIG. 1 is a perspective view of a fitness and exercise device in accordance with the principles of the present invention without a limb.

In accordance with the principles of the present invention, a fitness and exercise device is provided which incorporates magnetic force to provide resistance in the arms and/or legs and/or body. A fitness and exercise device of the present invention can be worn by the user by itself or it can be incorporated into a garment so as to generally conceal the device. A fitness and exercise device of the present invention provides resistance to the wearer of the device, thereby facilitating additional energy expenditure, muscle build up, and weight loss upon the swinging or bending of the arms and/or legs and/or body.

Thus, the present invention is directed to techniques for achieving resistance in an exercise device by the use of magnetic force emitted by magnetic force producing sources incorporated into pads worn by a wearer. In accordance with the present invention, the fitness and exercise device comprises two pads, sized to be disposed over the front side of the joint, with an upper pad overlying an upper part of the limb and with a lower pad overlying a lower part of the limb. The upper and lower pads at least partially wrap around left and right sides of the joint. The pads can be connected together at one end by means facilitating bending when the wearer's limb is bent at the joint.

To provide magnetic resistance, a first magnetic energy source is incorporated into the upper pad at a lower end of the pad and a second magnetic energy source, of opposite polar orientation to the orientation of the first magnetic energy source, is incorporated into the lower pad at an upper end of the pad. When the device is worn by the wearer on a joint with a limb in a straight position, the first magnetic energy source and the second magnetic energy source are positioned sufficiently close so that the magnetic energy sources attract. Due to the opposite magnetic polarity, the magnetic energy sources provide a resistance to an activity which would require the swinging or bending of the limb. In addition, in one embodiment at least one elastic element can be positioned in an area between the upper pad and the lower pad, or it can partially cover the upper and the lower pad. One end of the elastic element can be attached to the upper pad and the other end of the elastic element can be attached to lower pad, to provide additional resistance to an activity which would require the swinging or bending of the limb. The elastic element may be comprised of a stretchable or a bendable resistance producing material.

The energy expenditure device may be secured to the wearer's limb by adjustable straps. A first adjustable strap can be secured to the upper pad for wrapping around the rear side of a limb above the joint and a second adjustable strap can be provided for wrapping around the rear side of the limb below the joint.

The present invention may also be practiced in a manner wherein the device's structural features are located inside a garment so as to generally conceal the pads and the resistance elements.

High levels of resistance can be achieved by using strong magnetic energy sources to produce the desired high levels of resistance. Users can also vary resistance by replacing the magnetic energy sources with stronger or weaker magnetic energy sources. In addition, in at least one embodiment the magnetic energy sources can comprise electromagnets. Further, in at least one embodiment the magnetic energy sources can comprise an electromagnet and a ferromagnetic material capable of being attracted by an electromagnet. In these embodiments, users can vary resistance by varying the level of electric current flowing through the electromagnets. By varying resistance, users can engage in a greater range of exercises and activities. Further, by varying resistance, users can incorporate various strength training and muscle building activities into one workout regimen without the use of additional resistance producing devices. Finally, by varying resistance, users can engage in typical strength training and muscle building activities, whereby resistance is increased in subsequent sets of a particular routine.

Further, users can increase resistance without significantly increasing the overall weight or size of the device such as to significantly affect the comfort of wearing the device by the user or the portability of the device. This can allow the user to transport the device easily.

Referring now to FIGS. 1-4, an example of a fitness and exercise device in accordance with the principles of the present invention is described. The device includes an upper pad 10 and a lower pad 13 adapted to be disposed over the front side of a joint of the upper limb. The upper pad 10 is sized to be disposed over the front side of the joint overlying the upper part of the limb and the lower pad 13 is sized to be disposed over the front side of the joint overlying the lower part of the limb. The upper pad 10 and the lower pad 13 are sized to at least partially wrap around left and right sides of the joint.

The upper pad 10 and the lower pad 13 are connected together at a lower end of the upper pad and at an upper end of the lower pad to facilitate bending of the limb. In one embodiment, edges of the lower end of the upper pad 10 are connected to edges of the upper end of the lower pad 13 by edges of one pad being slightly inserted into groves 15 located in edges of the other pad. In other embodiments, a hinging mechanism can be utilized.

A first magnetic energy source 17 is incorporated into an upper end of the lower pad 13 and a second magnetic energy source 19 of an opposite polarity to the polarity of the first magnetic energy source 17 is incorporated into a lower end of the upper pad 10 so that the magnetic energy sources are positioned sufficiently close so that they attract when the limb is straight. Because of their opposite polarity, the first and the second magnetic energy sources attract and exert resistance upon the wearer when the limb is being bent, thereby creating resistance to an activity which would require the swinging or bending of the limb. Thus, greater force is required of the wearer to bend the limb. The pads are secured to the limb by the use of adjustable straps 21, 23 secured to the upper pad 10 and the lower pad 13.

Figure 2:
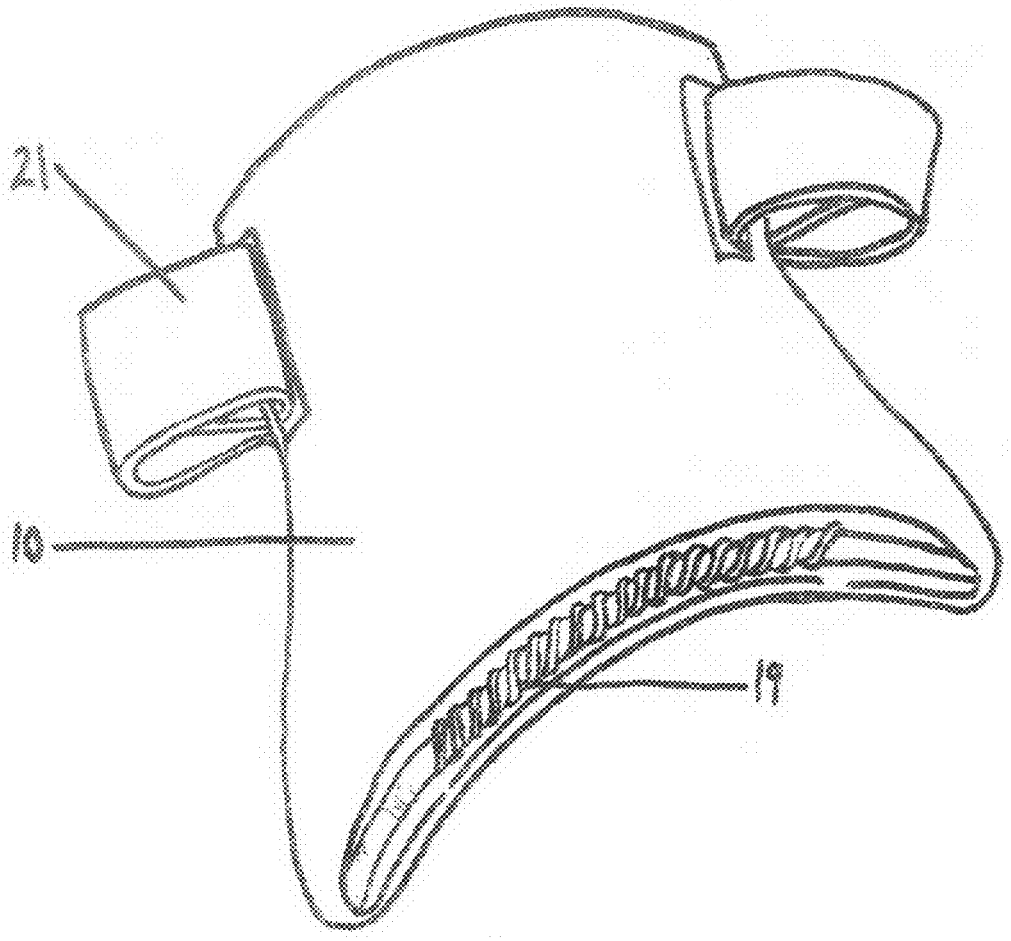
FIG. 2 a top cross-sectional view of an upper pad or a lower pad of the fitness and exercise device of FIG. 1 without a limb.
Figure 3:
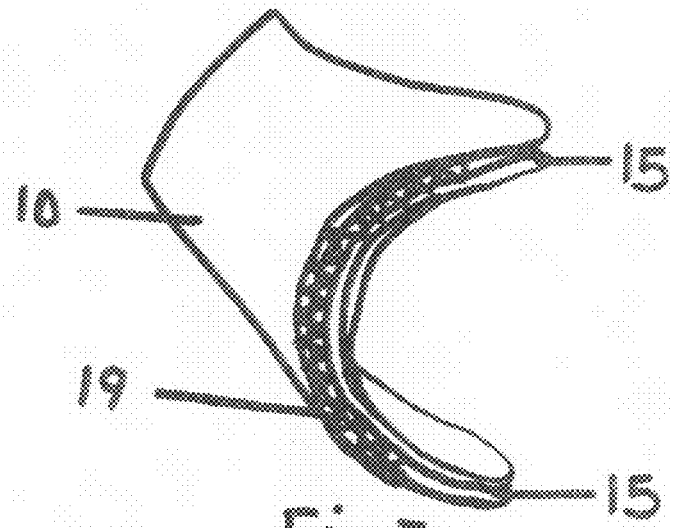
FIG. 3 is a front elevational cross sectional detailed view of the fitness and exercise device of FIG. 1 without a limb.
Figure 4:
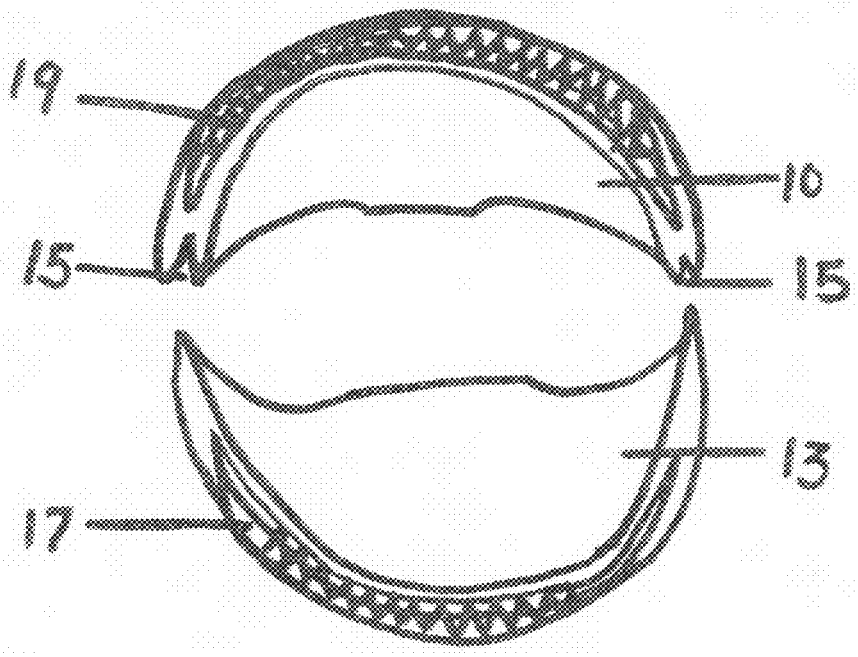
FIG. 4 is a top cross-sectional detailed view of the fitness and exercise device of FIG. 1 without a limb.
Figure 5:
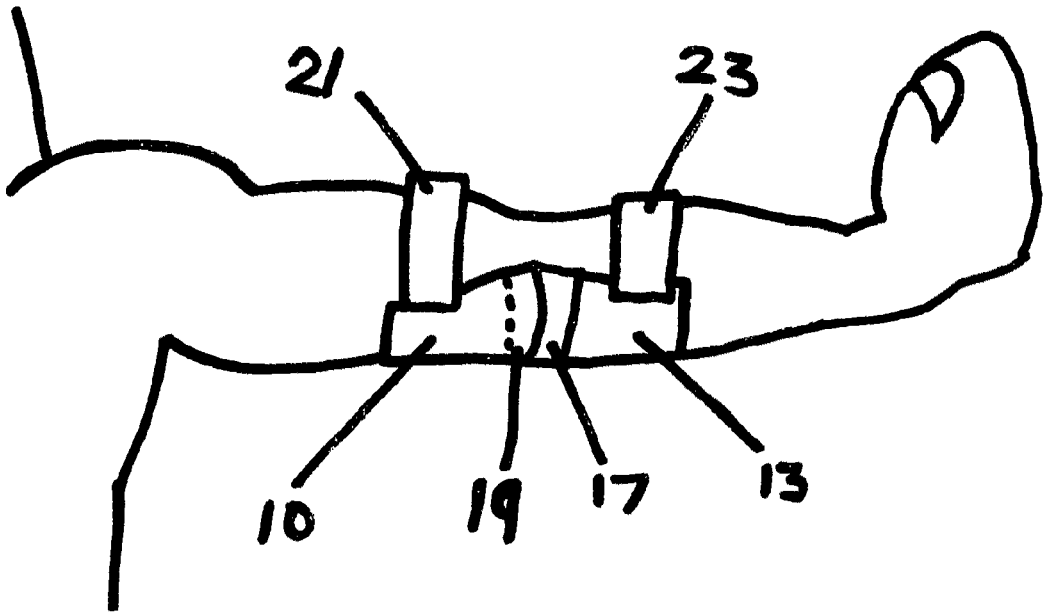
FIG. 5 is a side elevational cross-sectional detailed view of a fitness and exercise device of FIG. 1 on an elbow.

Referring now to FIGS. 5-8, use of the fitness and exercise device of FIGS. 1-3 is described. FIG. 5 is a side elevational cross-sectional detailed view of a fitness and exercise device of FIG. 1 on an elbow with the elbow straight. The device includes an upper pad 10 and a lower pad 13 sized to be disposed over the front side of the elbow. The upper pad 10 is sized to be disposed over the front side of the elbow overlying the upper part of the upper limb and the lower pad 13 is sized to be disposed over the front side of the elbow overlying the lower part of the upper limb. The upper pad 10 and the lower pad 13 are sized to at least partially wrap around left and right sides of the elbow.

The upper pad 10 and the lower pad 13 are connected together at a lower end of the upper pad and at an upper end of the lower pad to facilitate bending of the elbow. A first magnetic energy source 17 is incorporated into an upper end of the lower pad 13 and a second magnetic energy source 19 of an opposite polarity to the polarity of the first magnetic energy source 17 is incorporated into a lower end of the upper pad 10 so that the magnetic energy sources are positioned sufficiently close so that they attract when the upper limb is straight. Because of their opposite polarity, the first and the second magnetic energy 17, 19 sources attract and exert resistance upon the wearer when the upper limb is being bent, thereby creating resistance to an activity which would require the swinging or bending of the limb. Thus, greater force is required of the wearer to bend the limb. The pads 10, 13 are secured to the limb by the use of adjustable straps 21, 23 secured to the upper pad 10 and the lower pad 13.

Figure 7:
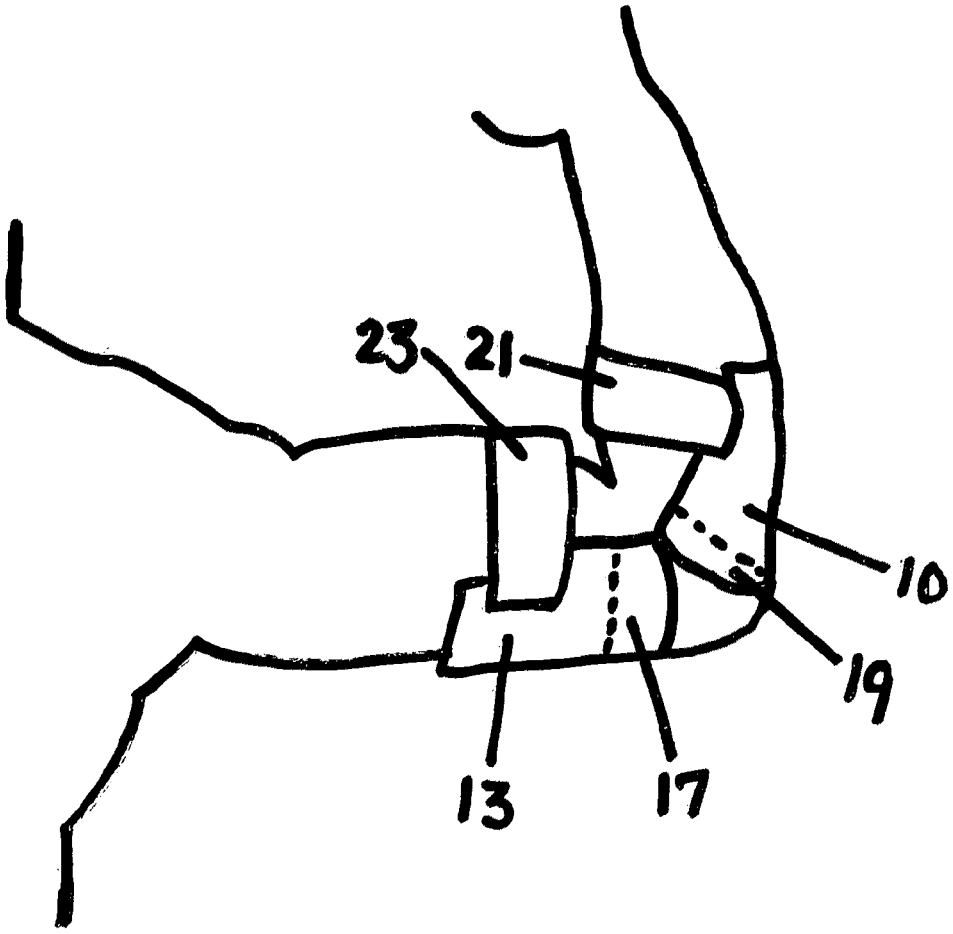
FIG. 7 is a side elevational cross-sectional detailed view of the fitness and exercise device of FIG. 1 on an elbow with the elbow bent.

FIG. 7 is a side elevational cross-sectional detailed view of a fitness and exercise device of FIG. 1 on an elbow with the elbow bent.

Figure 6:
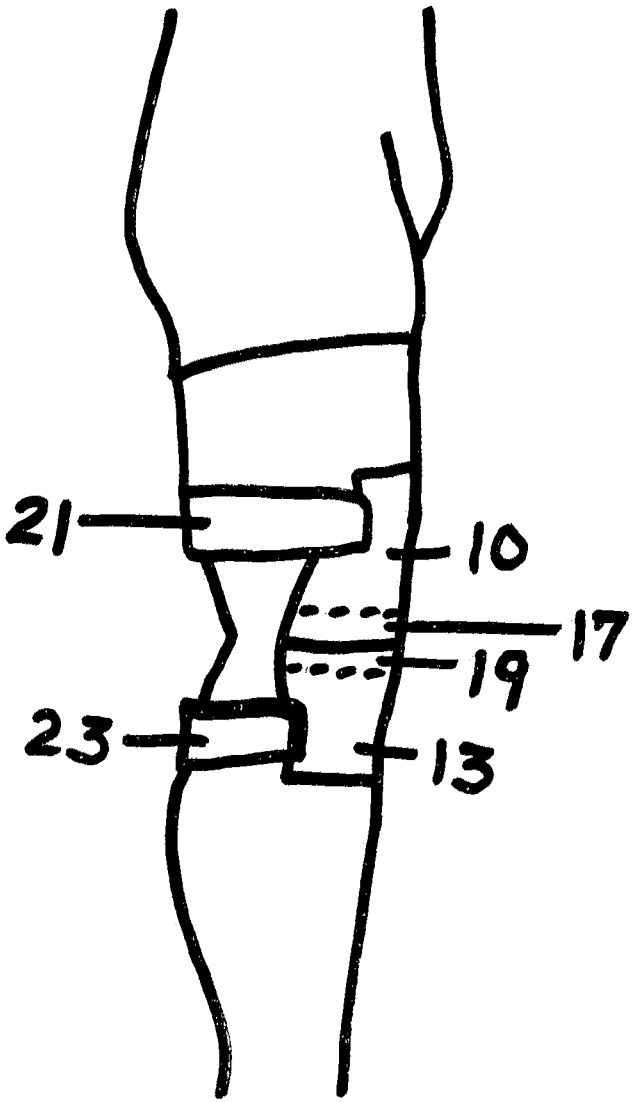
FIG. 6 is a side elevational cross-sectional detailed view of a fitness and exercise device of FIG. 1 on a knee.

FIG. 6 is a side elevational cross-sectional detailed view of a fitness and exercise device of FIG. 1 on a knee with the knee straight. The device includes an upper pad 10 and a lower pad 13 sized to be disposed over the front side of the knee. The upper pad 10 is sized to be disposed over the front side of the knee overlying the upper part of the lower limb and the lower pad 13 is sized to be disposed over the front side of the knee overlying the lower part of the lower limb. The upper pad 10 and the lower pad 13 are sized to at least partially wrap around left and right sides of the knee.

The upper pad 10 and the lower pad 13 are connected together at a lower end of the upper pad 10 and at an upper end of the lower pad 13 to facilitate bending of the knee. A first magnetic energy source 17 is incorporated into an upper end of the lower pad 13 and a second magnetic energy source 19 of an opposite polarity to the polarity of the first magnetic energy source 17 is incorporated into a lower end of the upper pad 10 so that the magnetic energy sources are positioned sufficiently close so that they attract when the lower limb is straight. Because of their opposite polarity, the first and the second magnetic energy sources 17, 19 attract and exert resistance upon the wearer when the lower limb is being bent, thereby creating resistance to an activity which would require the swinging or bending of the limb. Thus, greater force is required of the wearer to bend the limb. The pads 10, 13 are secured to the limb by the use of adjustable straps 21, 23 secured to the upper pad 10 and the lower pad 13.

Figure 8:
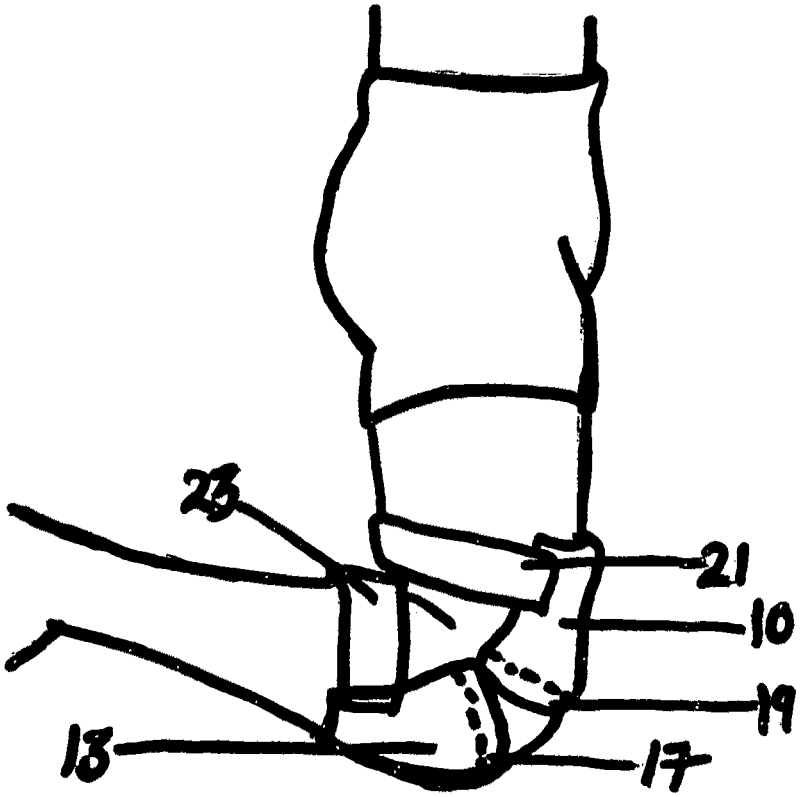
FIG. 8 is a side elevational cross-sectional view of the fitness and exercise device of FIG. 1 on a knee with the knee bent.

FIG. 8 is a side elevational cross-sectional detailed view of a fitness and exercise device of FIG. 1 on a knee with the knee bent.

While FIGS. 4-8 show the fitness and exercise device disposed over the upper and the lower limbs respectively, similar device could be disposed over other parts of the body. For example, the device could be disposed over the lower back of the wearer.

Figure 9:
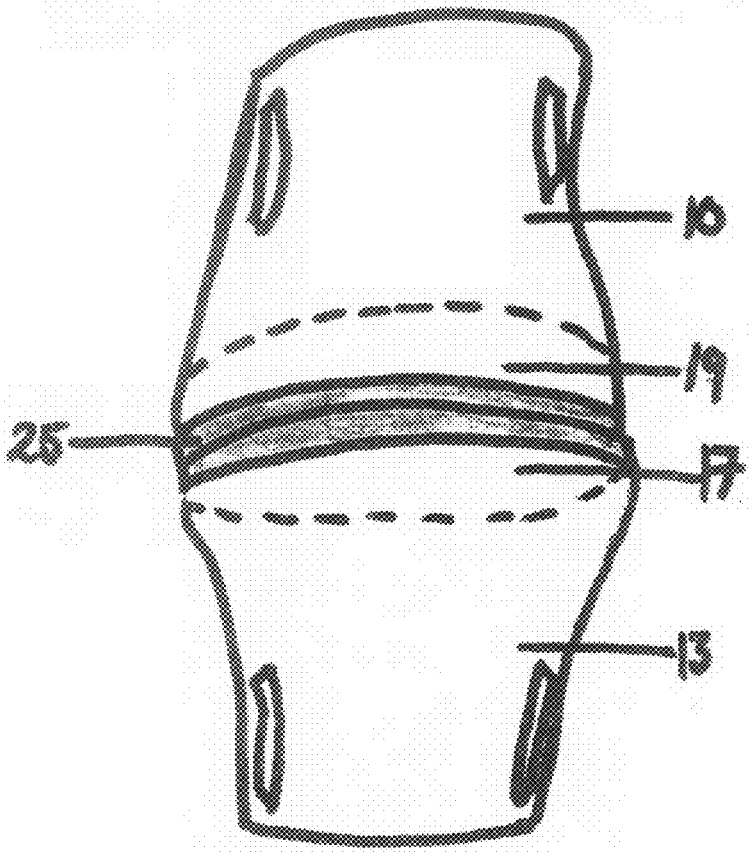
FIG. 9 is a front elevational view of a fitness and exercise device in accordance with the principles of the present invention without a limb.

Referring now to FIG. 9, a fitness and exercise device of FIGS. 1-3 containing an elastic resistance producing element 25 is described. The device includes an upper pad 10 and a lower pad 13 adapted to be disposed over the front side of a joint of a limb. The upper pad 10 is sized to be disposed over the front side of the joint overlying the upper part of the limb and the lower pad 13 is sized to be disposed over the front side of the joint overlying the lower part of the limb. The upper pad 10 and the lower pad 13 are sized to at least partially wrap around left and right sides of the joint.

A first magnetic energy source 17 is incorporated into an upper end of the lower pad 13 and a second magnetic energy source 19 of an opposite polarity to the polarity of the first magnetic energy source 17 is incorporated into a lower end of the upper pad 10 so that the magnetic energy 17, 19 sources are positioned sufficiently close so that they attract when the limb is straight. Because of their opposite polarity, the first and the second magnetic energy sources 17, 19 attract and exert resistance upon the wearer when the limb is being bent, thereby creating resistance to an activity which would require the swinging or bending of the limb. At least one elastic element 25 is positioned in an area between the upper pad 10 and the lower pad 13, or it can partially cover the upper pad 10 and the lower pad 13. One end of the elastic element is attached to the upper end of the upper pad 10 and the other end of the elastic element is attached to the lower end of the lower pad 13. The elastic element 25 exerts resistance upon the wearer when the limb is being bent, thereby creating resistance to an activity which would require the swinging or ending of the limb. Thus, greater force is required of the wearer to bend the limb.

Figure 10:
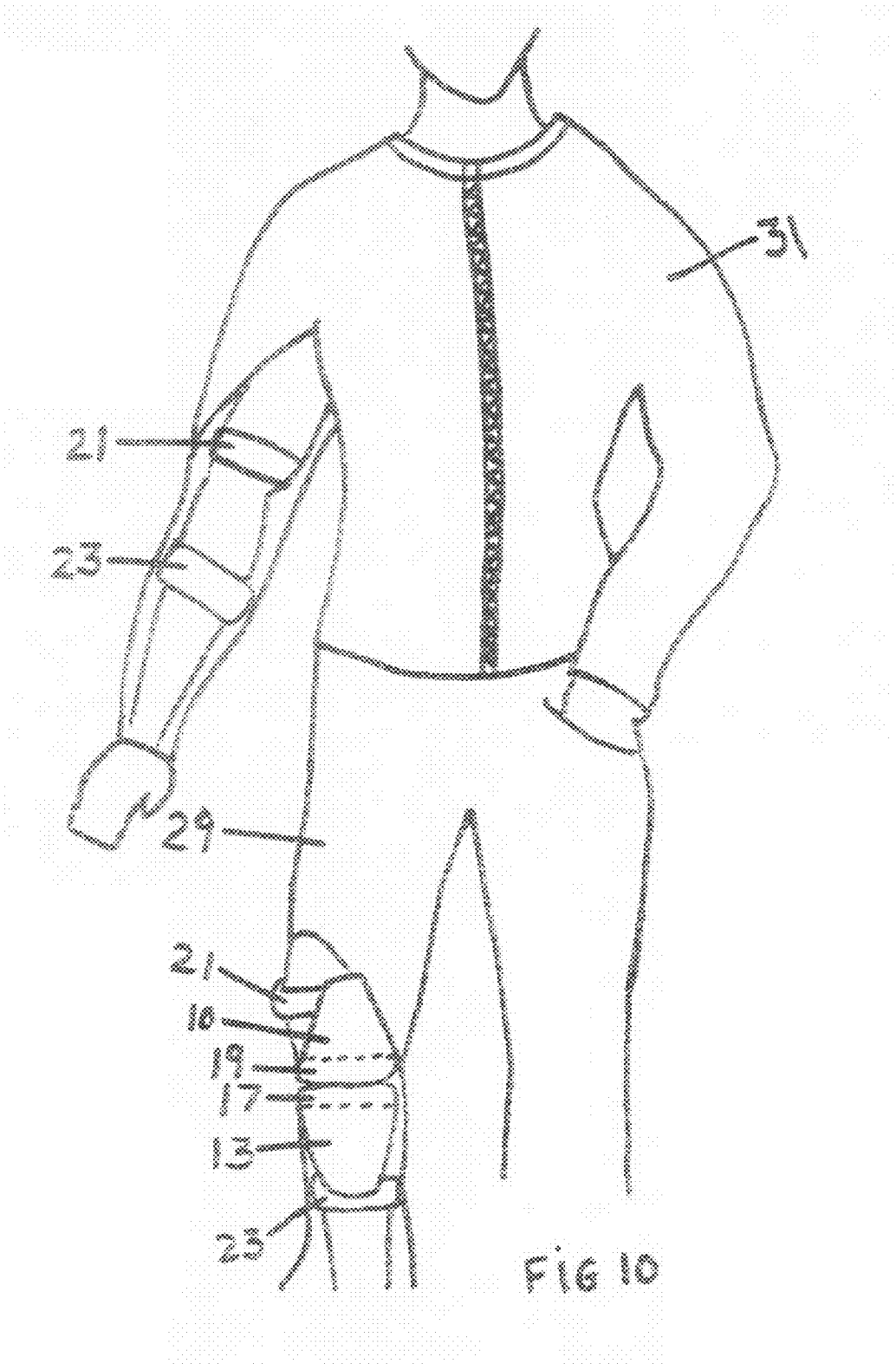
FIG. 10 is a front elevational cross-sectional detailed view of the fitness and exercise device of FIG. 1 secured within a garment.
Figure 11:
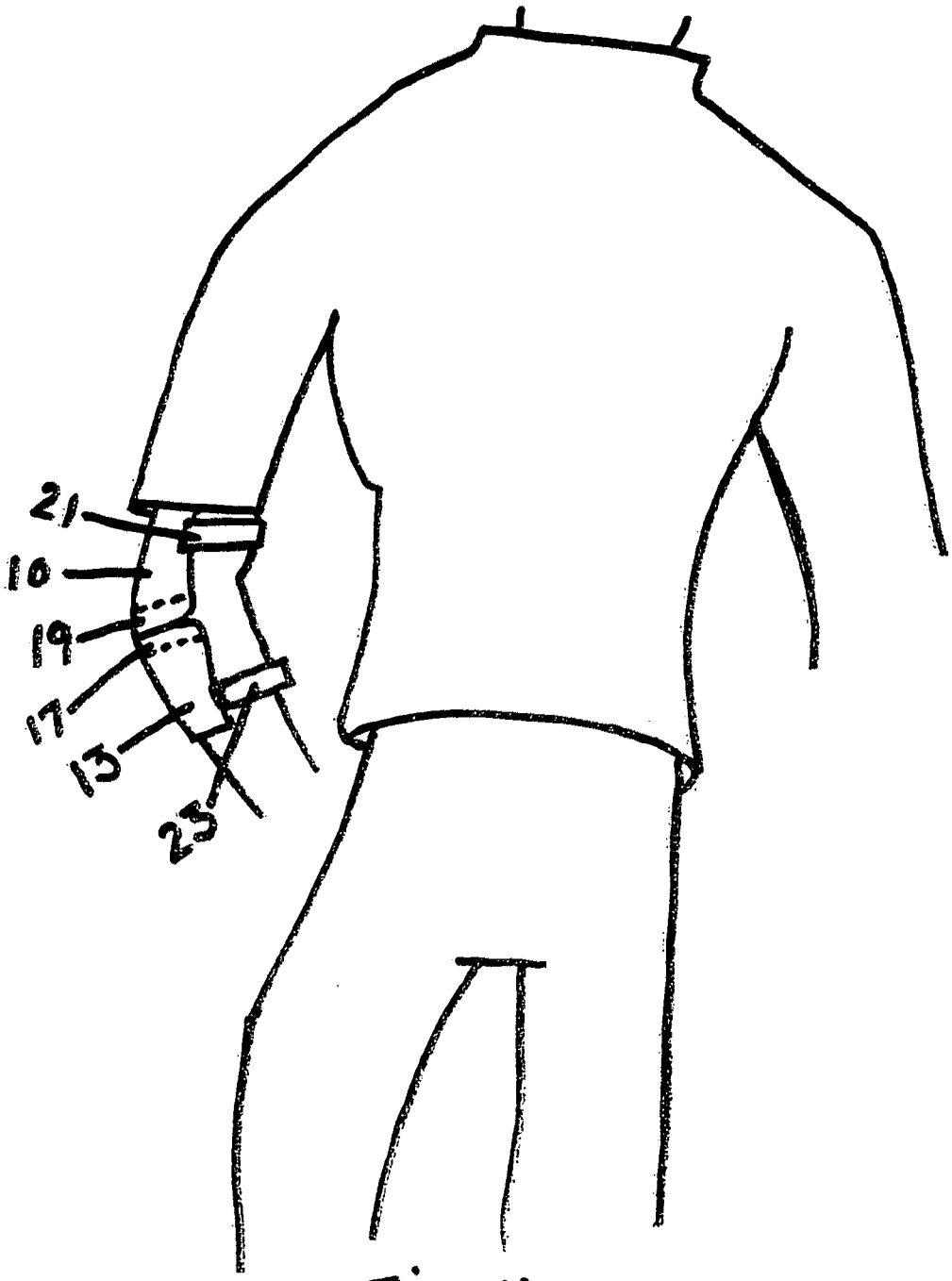
FIG. 11 is a front elevational cross-sectional detailed view of the fitness and exercise device of FIG. 1 secured within a garment.

FIGS. 10 and 11 illustrate the fitness and exercise device in accordance with the principles of the present invention being secured between two layers of a garment 27 having long sleeves 29 and pants 31 so as to generally conceal the device.

While FIGS. 10 and 11 show the device disposed over the upper limb and the lower limb located inside a garment 31, the device disposed over other parts of the body, such as the lower back, could also be located inside a garment 31.

It should be understood that various changes and modifications preferred in to the embodiment described herein would be apparent to those skilled in the art. Such changes and modifications can be made without departing from the spirit and scope of the present invention and without demising its attendant advantages. It is therefore intended that such changes and modifications be covered by the appended claims.

What is claimed is:

1. A fitness and exercise device comprising:

an upper pad and a lower pad, the upper pad sized to overly an upper part of a limb and the lower pad sized to overly a lower part of the limb, wherein the upper pad and the lower pad are secured together at a lower end of the upper pad and at an upper end of the lower pad to facilitate bending of a joint of the limb, wherein the lower end of the upper pad and the upper end of the lower pad have edges, wherein one of the edges has grooves, and wherein the edges of the lower end of the upper pad are connected to the edges of the upper end of the lower pad by edges of one pad being slightly inserted into the grooves in the edges of the other pad;

a fastener secured to the upper pad for wrapping around a rear side of an upper part of the limb and a fastener secured to the lower pad for wrapping around a rear side of a lower part of the limb;

a first magnetic energy source of one polar orientation being secured to an upper end of the lower pad and a second magnetic energy source of an opposite polar orientation to the orientation of the first magnetic energy source being secured to a lower end of the upper pad;

whereby the first and second magnetic energy sources generate resistance when the joint is bent, and wherein the magnetic energy sources are positioned sufficiently close such that the magnetic energy sources attract to one another when the limb is straight.

2. The fitness and exercise device of claim 1, further including at least one elastic element being attached to the lower end of the upper pad by an upper end of the elastic element and attached to the upper end of the lower pad by a lower end of the elastic element, whereby the elastic element generates additional resistance when the joint is bent.

3. The fitness and exercise device of claim 1, further wherein the first magnetic energy source is secured within the upper end of the lower pad and the second magnetic energy source is secured within the lower end of the upper pad.

4. The fitness and exercise device of claim 1, further wherein the upper and lower pads at least partially wrap around left and right sides of the joint.

5. The fitness and exercise device of claim 1, further wherein the first magnetic energy source and the second magnetic energy source are electromagnets.

6. The fitness and exercise device of claim 5, further wherein the first and second electromagnets are capable of producing varying levels of magnetic energy.

7. The fitness and exercise device of claim 1, further wherein the first magnetic energy source is an electromagnet and the second magnetic energy source is a ferromagnetic material.

8. The fitness and exercise device of claim 1, further wherein the first magnetic energy source is capable of producing varying levels of magnetic energy.

* * * * *